United States Patent [19]

Harvath

[11] 4,381,015

[45] Apr. 26, 1983

[54] HAIR CUTTING GUIDE

[76] Inventor: Rickie Harvath, P.O. Box 132, Blaine, Me. 04734

[21] Appl. No.: 273,636

[22] Filed: Jun. 15, 1981

[51] Int. Cl.[3] ..... A45D 24/00

[52] U.S. Cl. ..... 132/45 R; 132/45 A

[58] Field of Search ..... 132/45 R, 45 A, 45 B, 132/9, 106, 126

[56] References Cited

U.S. PATENT DOCUMENTS

| | | | |
|---|---|---|---|
| 2,864,162 | 12/1958 | MacDonald | 132/45 R |
| 3,572,351 | 3/1971 | Perry | 132/45 R |
| 3,848,611 | 11/1974 | Asaro | 132/45 |
| 4,010,764 | 3/1977 | Wagner | 132/45 R |

FOREIGN PATENT DOCUMENTS

| | | | |
|---|---|---|---|
| 560041 | 6/1923 | France | 132/45 A |
| 923827 | 4/1963 | United Kingdom | 132/45 R |

*Primary Examiner*—Robert A. Hafer

[57] ABSTRACT

A hair cutting device comprising a trough-like guide, open at both ends. Several length guides are available to provide for varying the length of hair to be cut or the guide may be made adjustable in length by including an adapter which works with the basic guide in a "telescoping" fashion.

1 Claim, 9 Drawing Figures

HAIR CUTTING GUIDE

BACKGROUND OF THE INVENTION

This invention relates to hair cutting and more specifically to a device which permits an untrained person to cut hair.

With the cost of having the hair cut by a professional barber, many individuals are turning to devices which permit the individual to cut his own hair. A popular device of this type is a combination razor and comb. The razor is adjustable on the comb permitting varying lengths of cut. Unfortunately, if the comb and razor are improperly tilted against the head too much, hair could be removed with obvious negative results.

SUMMARY OF THE INVENTION

The inventor's hair cutting device includes a group of trough-like guides, open at both terminal ends and having varying lengths. A rake-like comb may be used with the guides to assist in positioning the hair to be cut in the guides. An adapter having means of selectrively engaging a guide and having a configuration similar to the guide may be utilized to permit length of cut which lie between the fixed length of the guides.

BRIEF DESCRIPTION OF THE DRAWINGS

Further details are explained hereinafter with the help of the examples illustrated in the attached drawing in which.

DESCRIPTION OF THE PREFERRED EMBODIMENTS

Figure 1:
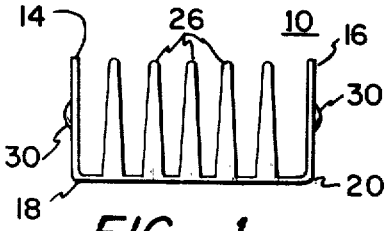
FIG. 1 is a front end elevational view of a hair cutting guide according to the present invention.
Figure 4:
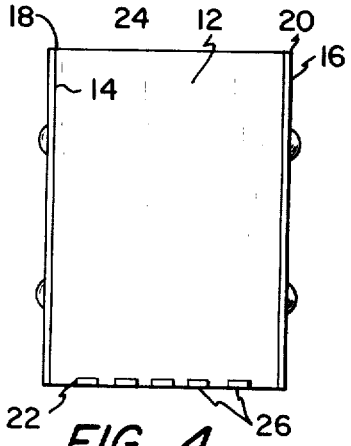
FIG. 4 is a top plan view of the hair cutting guide shown in FIG. 1.
Figure 5:
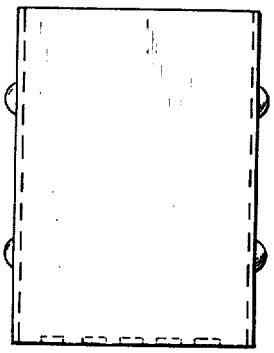
FIG. 5 is a bottom plan view of the hair cutting guide shown in FIG. 1.
Figure 7:
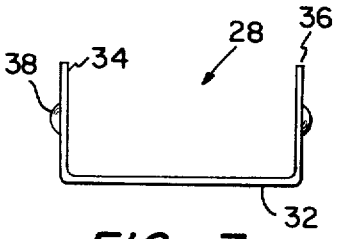
FIG. 7 is an end elevational view of an adapter for use with the hair cutting guide shown in FIG. 1.
Figure 6:
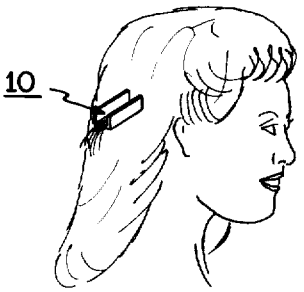
FIG. 6 is a perspective view showing a hair cutting guide of the invention positioned against the hair of a user with the hair in position for cutting.
Figure 8:
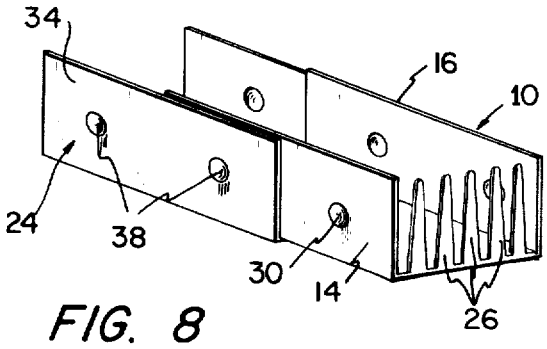
FIG. 8 is a perspective of an engagement between the hair cutting guide of FIG. 1 and the adapter of FIG. 7.

There is shown in the drawing a hair cutting guide 10 comprising a thin base portion 12, a thin first wall 14 and a thin second wall 16. The base portion 12 has a rectangular external configuration defined by a first long side edge 18, a second long side edge 20 in parallel relation to the first long side edge 18, a front edge 22 connecting the first and second long side edges 18, 20 and a rear edge 24. The first wall 14 is integral with and extends upwardly from the first long side edge 18. The second wall 16 is integral with and extends upwardly from the second long side edge 20 towards the same horizontal plane towards which the first wall 14 extends. The first and second walls 14, 16 are in spaced parallel relation to each other, are in right angle relation to the horizontal plane of the base portion 12 and are of equal height and length. The first and second walls 14, 16 and the base portion 21 define a rectangular trough-like configuration. The forward edges of the first and second walls 14, 16 and the front edge 22 provide a bearing end while the rear edges of the first and second walls 14, 16 and the rear edge 24 provide a free end. A series of teeth 26 are integral with and external upwardly from the front edge 22 on a plane transverse the planes of the first and second walls 14, 16 as shown in FIGS. 1 and 4. Each of the teeth 26 has the configuration of an elongated cone with a rounded apex and is approximately ¾ as high as the height of the first wall 14 and is spaced from the other teeth. The guide 10 may be formed of plastic or metal materials, for example, polyamides or aluminum.

A set of guides 10 may be provided to permit cutting of different lengths of hair. The set could include guides 1½", 2" and 2½" long, each having a base portion 12, a width of ¾" and having a first and second wall height of 1"; guides 3", 3½", 4" long each having a base portion 12 a width of 1" and having a first and second wall height of 1½" and guides 4½", 5" and 5½" long each having a base portion 12 a width of 1½" and having a first and second wall height of 2".

Figure 2:
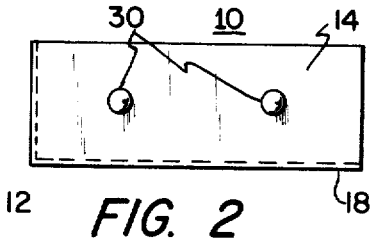
FIG. 2 is a side elevational view of the hair cutting guide shown in FIG. 1.
Figure 3:
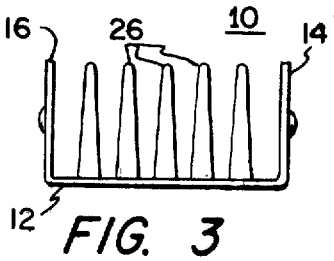
FIG. 3 is a rear end elevational view of the hair cutting guide shown in FIG. 1.

To provide for finer length adjustment, an adapter 28 is used with the guide 10. As shown in FIGS. 1–5, the first wall 14 and second wall 16 of the guide 10 each have a pair of hemispherical protuberances 30 which are formed on a longitudinal line drawn at about one half the height of the wall and which are spaced from each other as shown in FIG. 2. The protuberances 30 extend outwardly away from the external surface of the first and second walls 14, 15 on which they are formed and from the trough formed by the guide 10. The first protuberance 30 of the first wall 14 is positioned ½" from the front edge 22 and the second protuberance 30 is positioned ½" from the first protuberance 30. The protuberances 30 of the second wal1 16 are positioned using the same dimensions as those used to position the protuberance 30 formed on the first wall 14. The adapter 28 includes a rectangular base 32 having a first engagement wall 34 extending upwardly from and integral with one long edge of the base 32 and second engagement wall 36 extending upwardly from and integral with the other long edge of the base 32. The first and second walls 34, 36 are in spaced parallel relation with each other, are in right angle relation to the horizontal plane of the base 32, are of equal height and length, and form a trough-like configuration with the base 32. The base 32 of the adapter 28 is made slightly wider than the base portion 12 of the guide 10 to which it is to be engaged. However, the length of the base 32 and the height of the first and second engagement walls 34, 36 may be made equal to their counterparts in the guide 10 to which it is to be engaged (namely, the base portion 12 and the first and second walls 14, 16). A pair of hemispherical detents 38 are formed on the longitudinal midline of both the first and second engagement walls 34, 36. The detents are spaced from each other and extend outwardly away from the external surface of the first and second engagement walls on which they are formed. The first detent 38 on the first engagement wall 34 is formed ¼" from the terminal end of the adapter 28. The second detent 38 on the first engagement wall 34 is formed 1" from the first detent 38 and the detents 38 on the second engagement wall 36 are positioned using the same dimensions as those used to position the detents 38 formed on the first engagement wall 34.

The guide 10 is used with the adapter 28 by positioning the guide 10 within the adapter 28 with the base portion 12 in superposed abutting relation to the base 32, the outer surface of the first wall 14 bearing against the inner surface of the first engagement wall 34 and the outer surface of the second wall 16 bearing against the inner surface of the second engagement wall 36. The guide 10 is moveable within the adapter 28 so that a portion of the adapter 28 can in effect be added to the length of the guide 10 to vary the length of cut (as will be explained more fully hereinafter). The protuberances 30 will engage within the detents 38 to provide a more stable engagement than friction alone.

Figure 9:
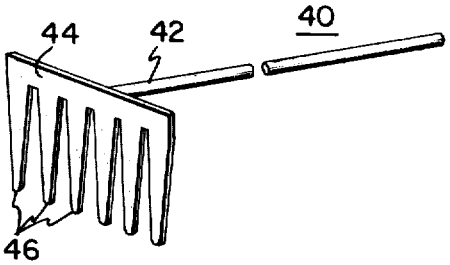
FIG. 9 is a perspective view of a hair rake for use with the hair cutting guide of FIG. 1 with the handle of the rake broken.

A hair rake 40 is shown in drawing at FIG. 9. The rake 40 comprises a cylindrical handle 42, a support bar 44 and a series of comb teeth 46, the handle 42 extends from the mid-point of the bar 44, and is in integral right angle relationship with the bar 44. The comb teeth 46 extend in planar relation to the bar 44 and in right angle relation to the longitudinal plane of the handle 42. The hair rake 40 may be formed of a plastic or of a light metal, for example, aluminum.

Prior to using the inventor's hair cutting guide 10, the hair on the head of the person whose hair is to be cut (the client) is made very wet by washing. The hair is then combed from the top of the head straight down and over all sides of the head (i.e., hair will extend over face, ears, etc.). The operator stands behind the client and measures the length of hair he desires to remain after cutting using a ruler. Since wet hair will shrink when it is dried, approximately ½" should be added to the measurement for a medium cut (i.e., 3–6 inches) and 1 inch should be added to the measurement for a long cut (i.e., 6 inches or longer). A guide 10 of the proper length (i.e., the length of cut) or the combination of a guide 10 and an adapter set to the proper length is used. The bearing end (includes the front edge 22) with the teeth pointed away from the floor on which the operator is positioned is placed against the center of the neck of the client below the hairline and the base portion 12 is positioned substantially parallel with the floor. Maintaining the guide 10 in position, the operator slides the guide 10 up the neck until the upper surface of the base portion 12 meets the hairline. The hair rake 40 is picked up and held in the operator's free hand, the comb teeth of the hair rake 40 are directed at the floor and the hair, directly above the trough formed by the guide 10, is rake (combed) into the guide 10 and a portion of the hair extends beyond the free end of the guide 10, the hair rake 40 is laid down and with the guide 10 maintained in position, the operator's free hand takes up a pair of scissors and the hair is cut flush with the free end of the guide 10. If possible, the points of the scissors are pointed away from the floor. The scissors are laid down and the guide 10 is maintained in place. The guide 10 is then moved up the head approximately 1" and the steps regarding the rake 40 and scissors are repeated. The guide 10 is moved up the head in this matter until the top center of the head is reached. When working on the top of the head, the head should be brought back with the eyes of the client directed at the ceiling in order to maintain the base portion 12 in parallel relation to the floor. After reaching the top of the head, the operator positions the guide 10 at the starting point on the neck and then moves the guide 10 right or left 1" and then repeats the cutting steps set out hereinbefore until the top of the head is reached. This procedure is continued until all the hair on the head of the client has been cut. When working on the front of the client's head his forehead is used as a starting point. If the client wishes longer hair on the back than on the sides, different length guides 10 can be used or the combination adapter 28-guide 10 can be properly adjusted.

What I claim is:

1. A hair cutting guide comprising a base portion and first and second side walls, the first and second side walls extending upwardly from the base portion in right angle relation thereto and in spaced relation to each other defining a bearing end and a free end and providing a trough like configuration and the guide including an inner sleeve, the inner sleeve having a base and side walls, the side walls extending upwardly from the base in spaced relation to each other, the inner sleeve positioned between the first and second side walls with the base in superposed relation to the base portion and the inner sleeve moveable longitudinally in relation to the base portion.

* * * * *